US012546317B2

(12) United States Patent
Wada et al.

(10) Patent No.: US 12,546,317 B2
(45) Date of Patent: Feb. 10, 2026

(54) COMPRESSOR INCLUDING REFRIGERANT INTRODUCTION TUBE

(71) Applicant: DAIKIN INDUSTRIES, LTD., Osaka (JP)

(72) Inventors: Ryosuke Wada, Osaka (JP); Chihiro Endou, Osaka (JP); Yuya Sunahara, Osaka (JP); Koichi Irikawa, Osaka (JP); Emu Kato, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 83 days.

(21) Appl. No.: 18/371,241

(22) Filed: Sep. 21, 2023

(65) Prior Publication Data

US 2024/0011491 A1 Jan. 11, 2024

Related U.S. Application Data

(63) Continuation of application No. PCT/JP2022/014407, filed on Mar. 25, 2022.

(30) Foreign Application Priority Data

Mar. 26, 2021 (JP) ..... 2021-053346

(51) Int. Cl.
*F04C 18/356* (2006.01)

(52) U.S. Cl.
CPC ..... *F04C 18/356* (2013.01); *F04C 2230/231* (2013.01); *F04C 2240/806* (2013.01)

(58) Field of Classification Search
CPC ..... F04C 2230/231; F04C 2240/806; F04C 18/356
See application file for complete search history.

(56) References Cited

U.S. PATENT DOCUMENTS 4,969,804 A * 11/1990 Gannaway ..... F04B 39/123 417/902
5,549,466 A * 8/1996 Hori ..... F04C 23/008 418/55.1
7,563,080 B2 * 7/2009 Masuda ..... F04C 23/001 418/59

(Continued)

FOREIGN PATENT DOCUMENTS

JP 57-102594 A 6/1982
JP 59-82595 A 5/1984

(Continued)

OTHER PUBLICATIONS

Machine Translation of JPs57102594A (Year: 1982).*

(Continued)

*Primary Examiner* — Christopher S Bobish
(74) *Attorney, Agent, or Firm* — Spencer Fane LLP

(57) ABSTRACT

A compressor includes a casing, a compression mechanism, and a refrigerant introduction tube. The casing includes a cylindrical portion surrounding an axis line. The compression mechanism includes a compression chamber. The compression mechanism is welded to the cylindrical portion at a first welding point. The refrigerant introduction tube is configured to guide a refrigerant to the compression chamber. The refrigerant introduction tube overlaps with the first welding point in a plan view seen along a direction in which the axis line extends.

13 Claims, 4 Drawing Sheets

(56) References Cited

U.S. PATENT DOCUMENTS

| | | | | |
|---|---|---|---|---|
| 7,618,242 | B2 * | 11/2009 | Higuchi | F04C 18/332 417/410.3 |
| 8,353,693 | B2 * | 1/2013 | Sotojima | F04C 18/32 418/59 |
| 8,356,986 | B2 * | 1/2013 | Higashi | F04C 23/001 417/310 |
| 8,419,395 | B2 * | 4/2013 | Furusho | F04C 18/322 418/59 |
| 8,430,656 | B2 * | 4/2013 | Byun | F04C 23/001 418/60 |
| 8,926,295 | B2 * | 1/2015 | Yanagisawa | F04C 18/322 417/423.15 |
| 8,956,131 | B2 * | 2/2015 | Nakamura | F04C 18/0276 418/55.6 |
| 9,011,121 | B2 * | 4/2015 | Yokoyama | F04C 29/12 418/60 |
| 10,851,780 | B2 * | 12/2020 | Yosuke | F04C 27/005 |
| 2011/0023535 | A1 * | 2/2011 | Morimoto | F25B 9/002 62/510 |

FOREIGN PATENT DOCUMENTS

| | | | |
|---|---|---|---|
| JP | 2009-13840 | A | 1/2009 |
| JP | 2009-222329 | A | 10/2009 |
| JP | 2012-117409 | A | 6/2012 |

OTHER PUBLICATIONS

European Search Report of corresponding EP Application No. 22 77 5826.5 dated Aug. 29, 2024.

International Preliminary Report of corresponding PCT Application No. PCT/JP2022/014407 dated Oct. 5, 2023.

International Search Report of corresponding PCT Application No. PCT/JP2022/014407 dated May 31, 2022.

* cited by examiner

COMPRESSOR INCLUDING REFRIGERANT INTRODUCTION TUBE

CROSS-REFERENCE TO RELATED APPLICATIONS

This is a continuation of International Application No. PCT/JP2022/014407 filed on Mar. 25, 2022, which claims priority to Japanese Patent Application No. 2021-053346, filed on Mar. 26, 2021. The entire disclosures of these applications are incorporated by reference herein.

BACKGROUND

Technical Field

The present disclosure relates to a compressor including a refrigerant introduction tube configured to guide refrigerant to a compression chamber.

Background Art

A compressor disclosed in Japanese Laid-Open Patent Publication No. S59-82595 includes a casing called a sealed container, and a compression mechanism configured to compress refrigerant. The compression mechanism includes a compression chamber. The compressor further includes a refrigerant introduction tube configured to guide a refrigerant outside the casing to the compression chamber.

SUMMARY

A compressor according to an aspect of this disclosure includes a casing, a compression mechanism, and a refrigerant introduction tube. The casing includes a cylindrical portion. The cylindrical portion surrounds an axis line. The compression mechanism includes a compression chamber. The compression mechanism is welded to the cylindrical portion at a first welding point. The refrigerant introduction tube is overlapped with the first welding point in plan view seen along a direction in which the axis line. The refrigerant introduction tube is configured to guide a refrigerant to the compression chamber.

DETAILED DESCRIPTION OF EMBODIMENT(S)

A refrigeration apparatus (1) according to a first embodiment uses carbon dioxide as a refrigerant to perform a two-stage compression refrigeration cycle. The refrigeration apparatus (1) can be used for an air conditioner, a water cooler/heater, refrigeration equipment, or any other similar system, for example.

Basic Embodiment

(1) Entire Configuration

Figure 1:
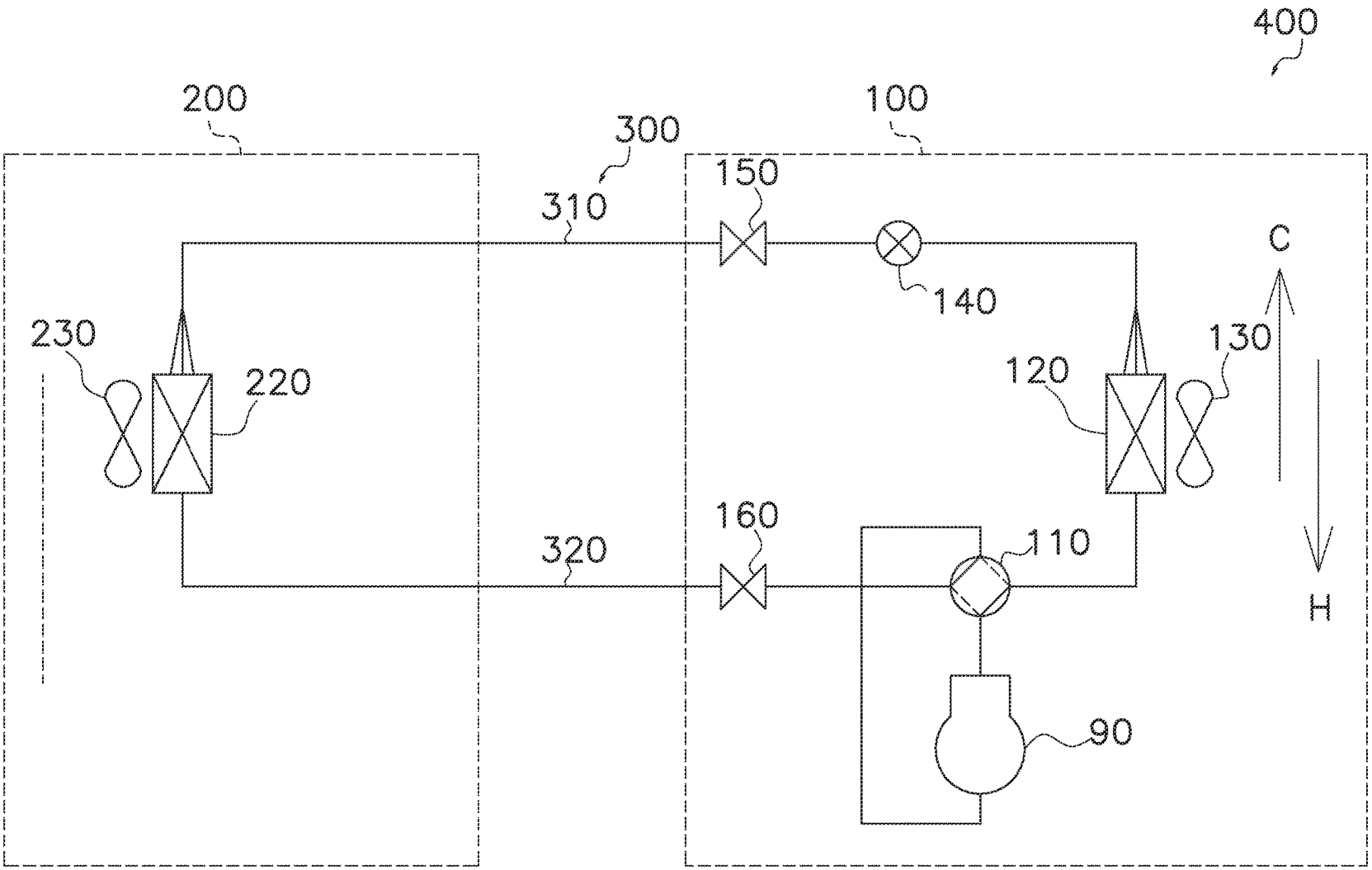
FIG. 1 is a circuit diagram of an air conditioner 400 according to a first embodiment.

FIG. 1 depicts an air conditioner 400 according to a basic embodiment. The air conditioner 400 includes an outdoor unit 100, an indoor unit 200, and connection pipes 300.

The outdoor unit 100 includes a compressor 90, a four-way switching valve 110, an outdoor heat exchanger 120, an outdoor fan 130, an outdoor expansion valve 140, a liquid shutoff valve 150, and a gas shutoff valve 160.

The indoor unit 200 includes an indoor heat exchanger 220 and an indoor fan 230.

The connection pipes 300 include a liquid connection pipe 310 and a gas connection pipe 320.

When the air conditioner 400 executes cooling operation, the four-way switching valve 110 achieves connection indicated by solid lines in FIG. 1 to allow a refrigerant to circulate in a direction indicated by an arrow C. During cooling operation, the indoor heat exchanger 220 functions as an evaporator and cooperates with the indoor fan 230 to supply a user with cool air. When the air conditioner 400 executes heating operation, the four-way switching valve 110 achieves connection indicated by broken lines in FIG. 1 to allow the refrigerant to circulate in a direction indicated by an arrow H. During heating operation, the indoor heat exchanger 220 functions as a condenser and cooperates with the indoor fan 230 to supply a user with warm air.

(2) Detailed Configuration of Compressor 90

Figure 2:
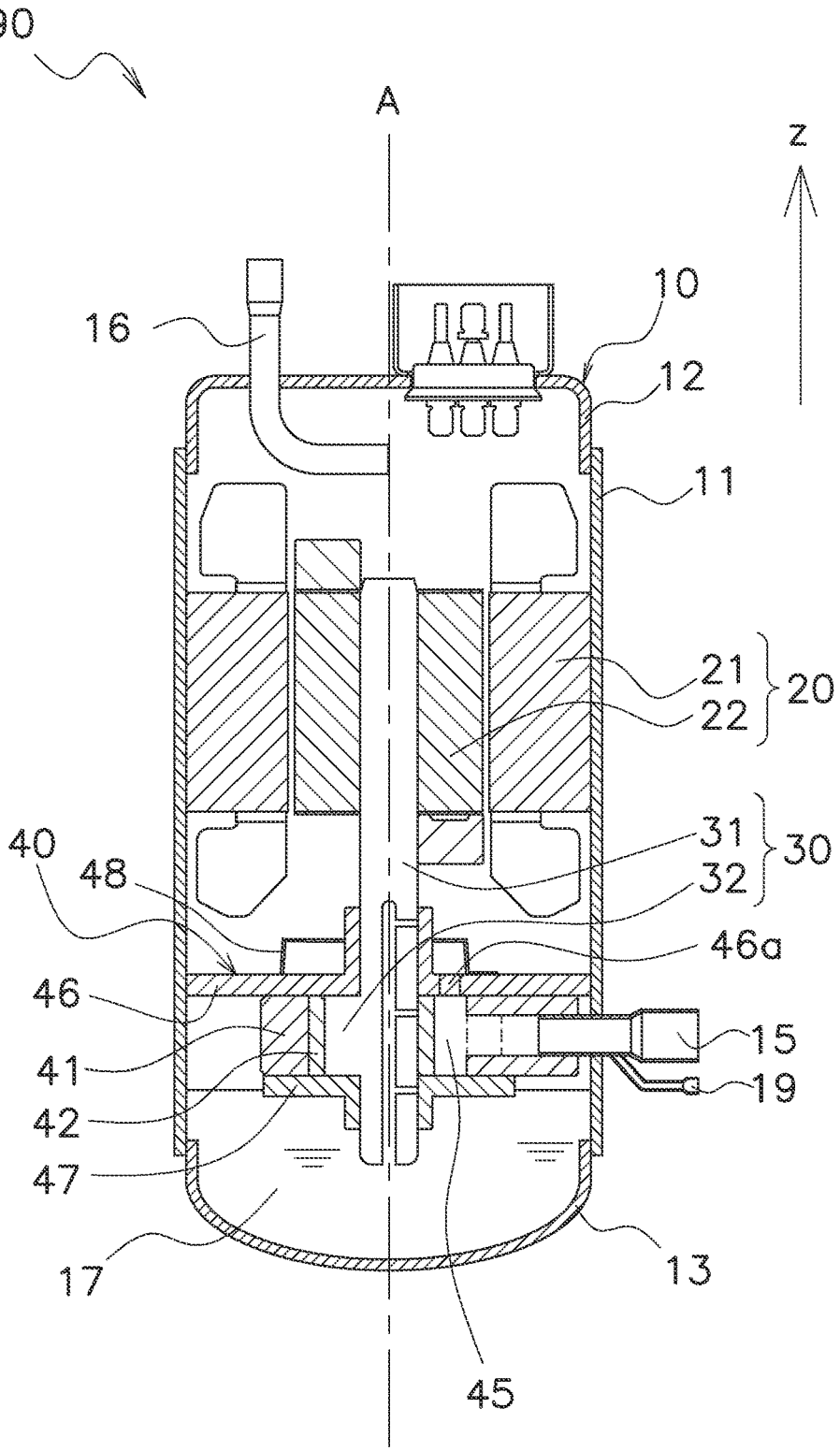
FIG. 2 is a sectional view of a compressor 90 taken along a vertical plane.

FIG. 2 depicts the compressor 90. The compressor 90 sucks a low-pressure gas refrigerant and compresses the refrigerant to generate a high-pressure gas refrigerant. The compressor 90 is a rotary compressor. The compressor 90 includes a casing 10, a suction tube 15, a discharge tube 16, an injection tube 19, a motor 20, a crankshaft 30, and a compression mechanism 40.

(2-1) Casing 10

The casing 10 accommodates various constituent elements of the compressor 90, a refrigerant, and lubricating oil. The casing 10 has a cylindrical portion 11, a lid 12, and a bottom 13 connected airtightly. The cylindrical portion 11 is shaped to be a rotation target with respect to an axis line A to surround the axis line A. The axis line A extends in a z direction. The casing 10 has an interior provided with an oil reservoir 17 reserving the lubricating oil.

(2-2) Motor 20

The motor 20 is supplied with electric power from outside the compressor 90, and generates motive power to drive the compression mechanism 40. The motor 20 is attached to the cylindrical portion 11. The motor 20 includes a stator 21 and a rotor 22.

The stator 21 has a cylindrical shape, and is attached to the cylindrical portion 11. The stator 21 converts electric power to an AC magnetic field.

The rotor 22 is disposed inside the stator 21. The rotor 22 interacts with the AC magnetic field generated by the stator 21 to rotate.

(2-3) Crankshaft 30

The crankshaft 30 is fixed to the rotor 22 to rotate along with the rotor 22. The crankshaft 30 transmits rotary force generated by the rotor 22 to the compression mechanism 40.

The crankshaft 30 includes a principal shaft portion 31 and an eccentric portion 32. The eccentric portion 32 is eccentric to the principal shaft portion 31. The principal shaft portion 31 is partially fixed to the rotor 22. The eccentric portion 32 is positioned in the compression mechanism 40.

(2-4) Compression Mechanism 40

The compression mechanism 40 compresses a low-pressure gas refrigerant to generate a high-pressure gas refrigerant. The compression mechanism 40 includes a cylinder 41, a piston 42, a front head 46, a rear head 47, and a muffler 48.

The cylinder 41 is a component made of a rigid body. The cylinder 41 has a cavity. The cavity accommodates the piston 42. The piston 42 is a cylindrical member. The piston 42 also has a cavity to which the eccentric portion 32 is attached. When the crankshaft 30 rotates, the piston 42 revolves while being in contact with the cylinder 41.

The cylinder 41 and the piston 42 cooperatively demarcate a compression chamber 45. The compression chamber 45 is a space surrounded by the cylinder 41 and the piston 42 in contact with each other. The compression chamber 45 has capacity increased or decreased in accordance with revolution of the piston 42.

The front head 46 closes an upper surface of the cylinder 41. The front head 46 is attached to the cylinder 41 such that the piston 42 is prevented from moving outward from the cylinder 41. The front head 46 is provided with a discharge port 46*a* configured to discharge a high-pressure gas refrigerant from the compression chamber 45. The front head 46 has a large diameter. The front head 46 is fixed to the cylindrical portion 11 of the casing 10. The compression mechanism 40 is thus entirely fixed to the casing 10. The rear head 47 closes a lower surface of the cylinder 41. The rear head 47 is attached to the cylinder 41 such that the piston 42 is prevented from moving outward from the cylinder 41. The muffler 48 is attached to the front head 46 so as to cover the discharge port 46*a*. The muffler 48 reduces noise caused by pressure pulsation of the high-pressure gas refrigerant discharged from the discharge port 46*a*.

(2-5) Suction Tube 15, Discharge Tube 16, and Injection Tube 19

The suction tube 15, the discharge tube 16, and the injection tube 19 are attached to the casing 10. The suction tube 15 guides a low-pressure gas refrigerant from outside the casing 10 to the compression chamber 45. The discharge tube 16 guides a high-pressure gas refrigerant provided in the casing 10 outward from the casing 10. The injection tube 19 guides a refrigerant typically having relatively small volume and intermediate pressure from outside the casing 10 to the compression chamber 45. The intermediate pressure herein is between pressure of a low-pressure refrigerant sucked via the suction tube 15 and pressure of a high-pressure gas refrigerant discharged from the discharge tube 16.

(3) Attachment Structure for Compression Mechanism 40

Figure 3:
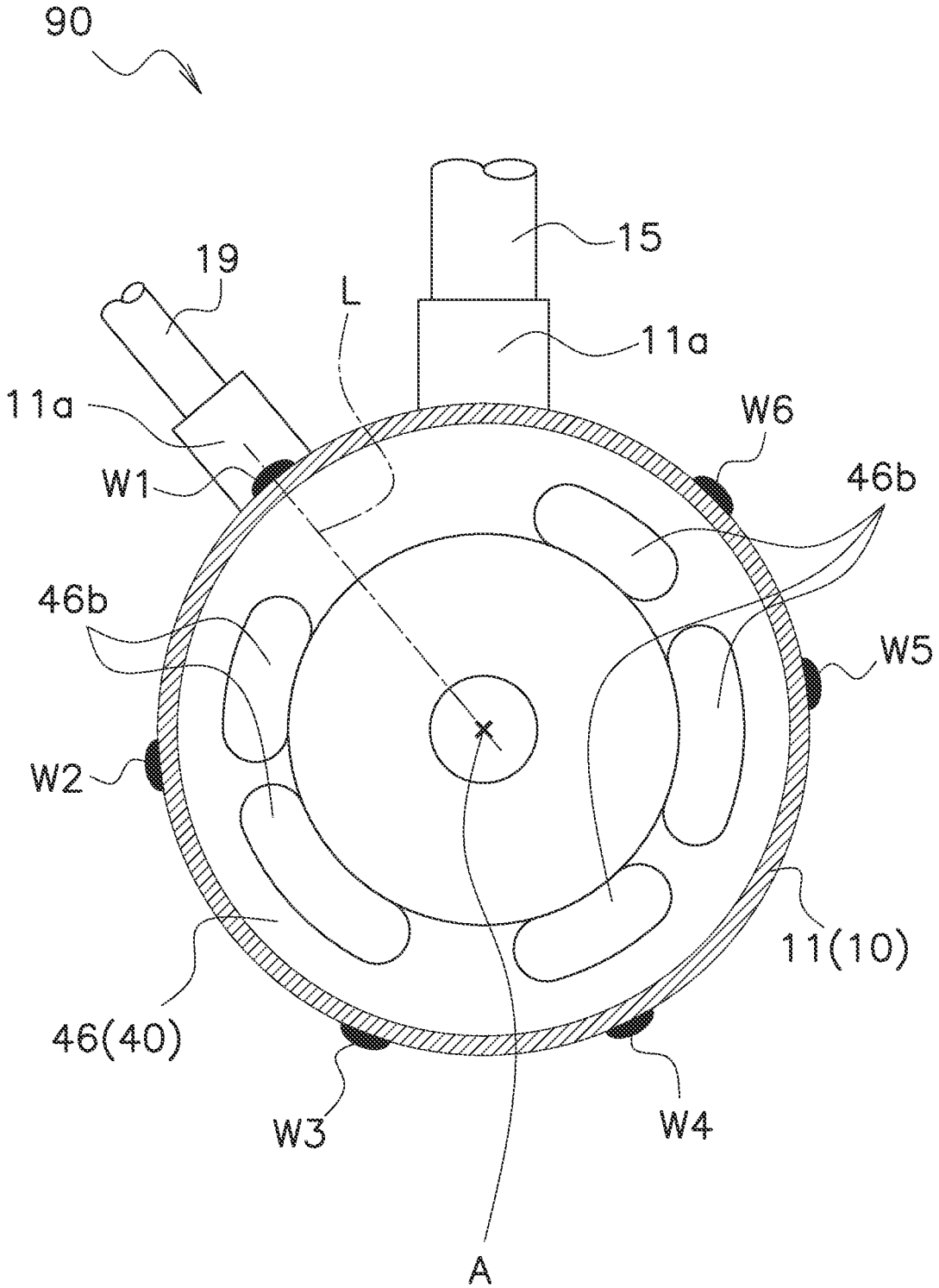
FIG. 3 is a sectional view of the compressor 90 taken along a horizontal plane.

FIG. 3 is a schematic sectional view taken along a horizontal plane, of the compressor 90, i.e. in plan view in a direction along extension of the axis line A. This figure depicts the cylindrical portion 11 of the casing 10 as a hatched section. Meanwhile, this figure depicts the top view of the front head 46 of the compression mechanism 40, the suction tube 15, and the injection tube 19.

The front head 46 of the compression mechanism 40 is fixed to the cylindrical portion 11 by welding at a first welding point W1, a second welding point W2, a third welding point W3, a fourth welding point W4, a fifth welding point W5, and a sixth welding point W6. The figure depicts a line segment L connecting the axis line A of the cylindrical portion 11 and the first welding point W1. The injection tube 19 extends along the line segment L. That is, in plan view in the z direction along extension of the axis line A in the figure, the injection tube 19 is overlapped with the first welding point W1.

The front head 46 of the compression mechanism 40 is provided with a penetrated portion 46*b*. The refrigerant in the casing 10 can pass the penetrated portion 46*b*. The penetrated portion 46*b* may further have a function of facilitating attachment of the compression mechanism 40 to the cylindrical portion 11, a function of facilitating connection of the suction tube 15 or the injection tube 19 to the cylindrical portion 11 or the compression mechanism 40, or the like. In the figure, the penetrated portion 46*b* is provided at a center portion of the compression mechanism 40. The penetrated portion 46*b* may alternatively be provided as a cut-away portion at a circumferential edge of the compression mechanism 40. The penetrated portion 46*b* is positioned such that the line segment L does not cross the penetrated portion 46*b*.

(4) Attachment Structure for Suction Tube 15 or Injection Tube 19

Figure 4:
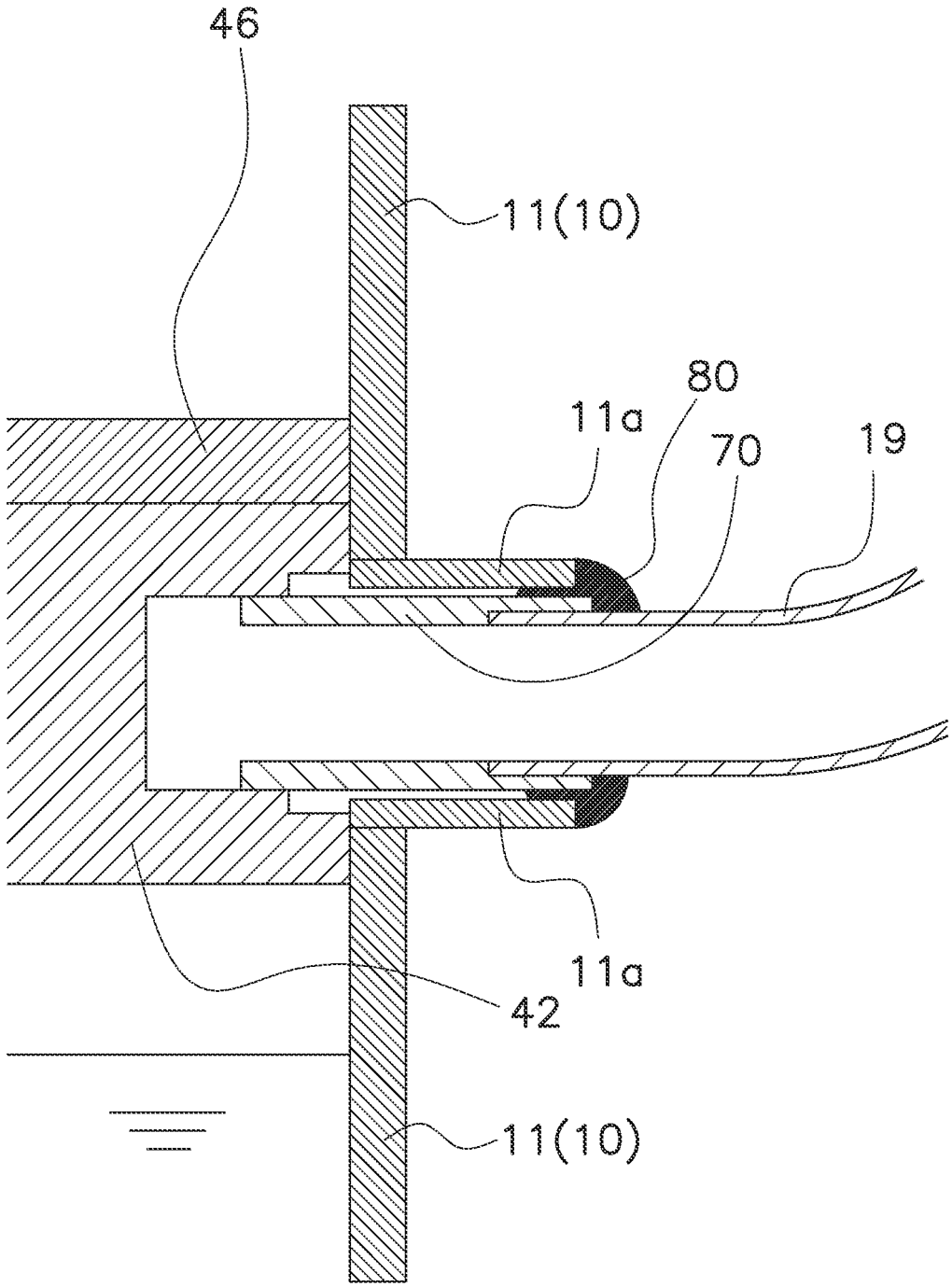
FIG. 4 is a sectional view depicting an injection tube 19 and peripheral structures.

FIG. 4 depicts the injection tube 19 and its periphery.

The casing 10 further includes a cylindrical joint tube 11*a* standing on the cylindrical portion 11. The joint tube 11*a* is welded to the cylindrical portion 11. The injection tube 19, which is connected to a cylindrical inlet 70, is inserted to the joint tube 11*a*. The inlet 70 is inserted to the compression mechanism 40. The inlet 70 guides a refrigerant from the injection tube 19 to the compression chamber 45 of the compression mechanism 40. The joint tube 11*a* surrounds the injection tube 19 and the inlet 70.

The casing 10 and the injection tube 19 are fixed to each other by a brazing filler material 80. The brazing filler material 80 can be applied to various locations. For example, the injection tube 19, the joint tube 11*a*, and the inlet 70 may be mutually fixed by the brazing filler material 80.

The injection tube 19 is attached to the cylindrical portion 11 so as not to project into an internal space of the cylindrical portion 11.

The attachment structure described above with regard to the injection tube 19 may be applied to the suction tube 15.

(5) Characteristics 5-1

Pressure pulsation of the refrigerant causes vibration of the injection tube 19 in an array direction of the cylindrical portion 11 and the first welding point W1, that is, along the line segment L. The cylindrical portion 11 and the injection tube 19 are thus less likely to move differently even upon application of vibration, for reduced vibration of the compressor 90.

5-2

The injection tube 19 extends in an array direction of the cylindrical portion 11, the first welding point W1, and the injection tube 19. Even if pressure pulsation of the refrigerant generates vibration in a direction along extension of the injection tube 19, vibration of the compressor 90 can thus be reduced.

5-3

The cylindrical portion 11 and the compression mechanism 40 are fixed at the second welding point W2, the third welding point W3, the fourth welding point W4, the fifth welding point W5, and the sixth welding point W6, as well as at the first welding point W1. This can more effectively reduce vibration of the compressor 90.

5-4

The brazing filler material 80 secures fixation between the casing 10 and the injection tube 19, so that the injection tube 19 does not need to project into the internal space of the cylindrical portion 11 for stable assembly. This facilitates disposition of the first welding point W1 realizing fixation between the cylindrical portion 11 and the compression mechanism 40.

5-5

The injection tube 19, the joint tube 11*a*, and the inlet 70 are mutually fixed by the brazing filler material 80. This inhibits any possible rattling between these components.

5-6

The line segment L connecting the axis line A and the first welding point W1 does not pass the penetrated portion 46*b* of the compression mechanism 40. The penetrated portion 46*b* is thus less likely to be resonated by pressure pulsation of the refrigerant.

5-7

The line segment L connecting the axis line A and the first welding point W1 does not penetrate the penetrated portion 46*b* provided at the front head 46. This can reduce influence of the front head 46 on vibration.

5-8

Vibration of the compressor 90 is reduced to stabilize behavior of the air conditioner 400 for higher safety.

(6) Modification Examples (6-1) First Modification Example of Basic Embodiment

In the compressor 90 according to the basic embodiment, the compression mechanism 40 includes the single cylinder 41. The compression mechanism 40 may alternatively include two or more cylinders 41.

(6-2) Second Modification Example of Basic Embodiment

In the compressor 90 according to the basic embodiment, the injection tube 19 is overlapped with the first welding point W1 in plan view in the z direction along extension of the axis line A to inhibit vibration caused by pressure pulsation of the injection tube 19. Alternatively or additionally, the suction tube 15 may be overlapped with any of the welding points in the z direction along extension of the axis line A.

(6-3) Third Modification Example of Basic Embodiment

In the compressor 90 according to the basic embodiment, the injection tube 19, the joint tube 11*a*, and the inlet 70 are mutually fixed by the single brazing filler material 80. There may alternatively be provided a plurality of types of brazing filler materials in order to mutually fix at least partially the injection tube 19, the suction tube 15, the cylindrical portion 11, the joint tube 11*a*, and the inlet 70.

Conclusion

The embodiments of the present disclosure have been described above. It will be understood that various modifications to modes and details are possible without departing from the object and the scope of the present disclosure recited in the claims.

The invention claimed is:

1. A compressor comprising:

a casing including a cylindrical portion surrounding an axis line;

a compression mechanism including a compression chamber, the compression mechanism being welded to the cylindrical portion at a first welding point;

a suction tube configured to guide refrigerant having a low pressure to the compression chamber;

a discharge tube configured to guide refrigerant having a high pressure to outside the casing; and an injection tube configured to guide refrigerant having an intermediate pressure to the compression chamber, the intermediate pressure being between the low pressure and the high pressure, and the injection tube overlapping with the first welding point in a plan view seen along a direction in which the axis line extends, the injection tube extending along a line segment connecting the axis line and the first welding point.

2. The compressor according to claim 1, wherein the compression mechanism includes a penetrated portion allowing the refrigerant to pass in the direction along extension of the axis line, and the line segment connecting the axis line and the first welding point does not cross the penetrated portion.

3. The compressor according to claim 2, wherein the compression mechanism includes a cylinder, a piston forming the compression chamber in cooperation with the cylinder, and a head attached to the cylinder to prevent the piston from moving outward from the cylinder.

4. The compressor according to claim 3, wherein the penetrated portion is provided at the head.

5. The compressor according to claim 4, wherein the first welding point fixes between the head and the cylindrical portion.

6. The compressor according to claim 3, wherein the first welding point fixes between the head and the cylindrical portion.

7. An air conditioner including the compressor according to claim 1.

8. The compressor according to claim 1, wherein the compression mechanism is further welded to the cylindrical portion at a second welding point.

9. The compressor according to claim 8, further comprising:

a brazing filler material fixing at least between the casing and the injection tube, the injection tube not projecting into an internal space of the cylindrical portion.

10. The compressor according to claim 1, further comprising:

a brazing filler material fixing at least between the casing and the injection tube, the injection tube not projecting into an internal space of the cylindrical portion.

11. An air conditioner including the compressor according to claim 3.

12. A compressor comprising:

a casing including a cylindrical portion surrounding an axis line;

a compression mechanism including a compression chamber, the compression mechanism being welded to the cylindrical portion at a first welding point;

a suction tube configured to guide refrigerant having a low pressure to the compression chamber;

a discharge tube configured to guide refrigerant having a high pressure to outside the casing;

an injection tube configured to guide refrigerant having an intermediate pressure to the compression chamber, the intermediate pressure being between the low pressure and the high pressure, and the injection tube overlapping with the first welding point in a plan view seen along a direction in which the axis line extends; and a brazing filler material fixing at least between the casing and the injection tube, the injection tube not projecting into an internal space of the cylindrical portion.

13. The compressor according to claim 12, further comprising:

an inlet having a cylindrical shape, inserted to the compression mechanism, and configured to guide the refrigerant from the injection tube to the compression chamber, the casing further including a joint tube surrounding the injection tube, and the injection tube, the joint tube, and the inlet being mutually fixed by the brazing filler material.

* * * * *